US011431134B2

(12) United States Patent
Huang et al.

(10) Patent No.: US 11,431,134 B2
(45) Date of Patent: Aug. 30, 2022

(54) HIGH-SPEED CONNECTOR

(71) Applicant: DONGGUAN LUXSHARE TECHNOLOGIES CO., LTD, Dongguan (CN)

(72) Inventors: Bin Huang, Dongguan (CN); Rongzhe Guo, Dongguan (CN); Hongji Chen, Dongguan (CN); Huanhuan Shen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 29 days.

(21) Appl. No.: 17/215,609

(22) Filed: Mar. 29, 2021

(65) Prior Publication Data

US 2021/0320460 A1 Oct. 14, 2021

(30) Foreign Application Priority Data

Apr. 14, 2020 (CN) ..... 202010289565.1

(51) Int. Cl.

| | |
|---|---|
| ***H01R 13/6594*** | (2011.01) |
| ***H01R 13/40*** | (2006.01) |
| ***H01R 13/502*** | (2006.01) |
| ***H01R 13/6599*** | (2011.01) |

(52) U.S. Cl.

CPC ..... *H01R 13/6594* (2013.01); *H01R 13/40* (2013.01); *H01R 13/502* (2013.01); *H01R 13/6599* (2013.01)

(58) Field of Classification Search

CPC .. H01R 13/6594; H01R 13/40; H01R 13/502; H01R 13/6599; H01R 13/6588; H01R 12/75; H01R 13/6591

See application file for complete search history.

(56) References Cited

U.S. PATENT DOCUMENTS

| | | | | |
|---|---|---|---|---|
| 7,226,316 | B2 * | 6/2007 | Wu | H01R 13/6275 439/484 |
| 9,991,639 | B2 | 6/2018 | Resendez et al. | |
| 10,833,437 | B2 * | 11/2020 | Huang | H01R 12/58 |

(Continued)

FOREIGN PATENT DOCUMENTS

| | | |
|---|---|---|
| CN | 202474339 U | 10/2012 |
| CN | 102957055 A | 3/2013 |

(Continued)

*Primary Examiner* — Abdullah A Riyami
*Assistant Examiner* — Nader J Alhawamdeh
(74) *Attorney, Agent, or Firm* — Birch, Stewart, Kolasch & Birch, LLP

(57) ABSTRACT

The present disclosure discloses a high-speed connector including an insulating body, a number of conductive terminals, a number of conductive terminals, and a conductive plastic. The insulating body has a back surface. The conductive terminals are retained in the insulating body. The conductive plastic is disposed on the back surface of the insulating body. The cables are electrically connected with the conductive terminals. The cables extend beyond the back surface of the insulating body. The cables pass out of the conductive plastic. The high-speed connector of the present disclosure prevents the interference of electromagnetic signals at the back surface of the insulating body where the cables pass through.

18 Claims, 15 Drawing Sheets

(56) References Cited

U.S. PATENT DOCUMENTS

| | | | | |
|---|---|---|---|---|
| 2013/0188325 | A1* | 7/2013 | Garman | H05K 9/0007 29/829 |
| 2019/0267732 | A1* | 8/2019 | Buck | H01R 12/59 |
| 2019/0372251 | A1* | 12/2019 | Huang | H01R 12/79 |
| 2020/0321727 | A1* | 10/2020 | Li | H01R 13/6275 |
| 2021/0013644 | A1* | 1/2021 | Huang | H01R 12/58 |
| 2021/0320460 | A1* | 10/2021 | Huang | H01R 13/40 |

FOREIGN PATENT DOCUMENTS

| | | | | |
|---|---|---|---|---|
| CN | 205863449 | U | | 1/2017 |
| CN | 109038115 | A | | 12/2018 |
| CN | 109256643 | A | | 1/2019 |
| CN | 208955288 | U | | 6/2019 |
| CN | 208955337 | U | | 6/2019 |
| CN | 209169430 | U | | 7/2019 |
| CN | 209169534 | U | | 7/2019 |
| CN | 110401052 | A | | 11/2019 |
| CN | 110518412 | A | * | 11/2019 |
| DE | 10 2014 224 225 | B4 | | 9/2016 |
| TW | M481522 | U | | 7/2014 |
| TW | M537332 | U | | 2/2017 |
| TW | I625010 | B | | 5/2018 |
| TW | 202025574 | A | | 7/2020 |

* cited by examiner

HIGH-SPEED CONNECTOR

CROSS-REFERENCE TO RELATED APPLICATION

This patent application claims a priority of a Chinese Patent Application No. 202010289565.1, filed on Apr. 14, 2020 and titled "HIGH-SPEED CONNECTOR", the entire content of which is incorporated herein by reference.

TECHNICAL FIELD

The present disclosure relates to an electrical connector, in particular to a high-speed connector.

BACKGROUNDING

With the continuous development of electronic technology, as a low-cost and short-distance connection solution, high-speed connectors are widely used in SATA (Serial Advanced Technology Attachment) storage devices, RADI (Redundant Arrays of Independent Drives) systems, core routers, (10G or 40G) Ethernet, etc. High-speed cables have excellent attenuation performance, low delay performance and anti-interference performance, and can realize high-frequency broadband transmission. The high-speed cable connector includes an insulating body, a number of conductive terminals, a cable and a shielding shell. Although the shielding shell realizes electromagnetic shielding to a certain extent, it is usually not realized on the side where the cable passes through. During the transmission of high-speed signals, the side where the cable passes through is still vulnerable to electromagnetic signals.

SUMMARY

An object of the present disclosure is to provide a high-speed connector, which achieves a shielding effect at the back surface of the insulating body where the cables pass through.

In order to achieve the above object, the present disclosure discloses a high-speed connector including an insulating body, a number of conductive terminals, a number of conductive terminals, and a conductive plastic. The insulating body has a back surface. The conductive terminals are retained in the insulating body. The conductive plastic is disposed on the back surface of the insulating body. The cables are electrically connected with the conductive terminals. The cables extend beyond the back surface of the insulating body. The cables pass out of the conductive plastic.

In order to achieve the above object, the present disclosure further discloses a high-speed connector including an insulating body, a plurality of conductive terminals, a shielding shell, and a conductive plastic. The insulating body has a lower surface and a back surface that is distinguished from the lower surface. The conductive terminals are retained in the insulating body. The shielding shell covers the insulating body except for the lower surface and the back surface. The conductive terminals extend below the lower surface of the insulating body for connection with a circuit board. The conductive plastic is disposed on the back surface of the insulating body.

Compared with the prior art, conductive plastic is disposed on the back surface of the insulating body of the present disclosure so as to prevent the interference of electromagnetic signals at the back surface of the insulating body where the cables pass through.

DETAILED DESCRIPTION

Figure 1:
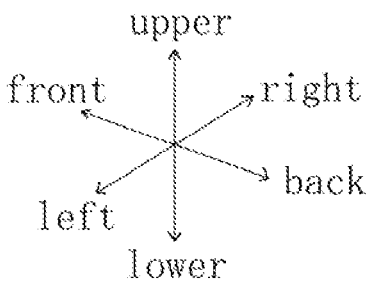
FIG. 1 is a perspective, assembled view of a high-speed connector in accordance with an embodiment of the present disclosure, which is mounted on a circuit board.
Figure 1:
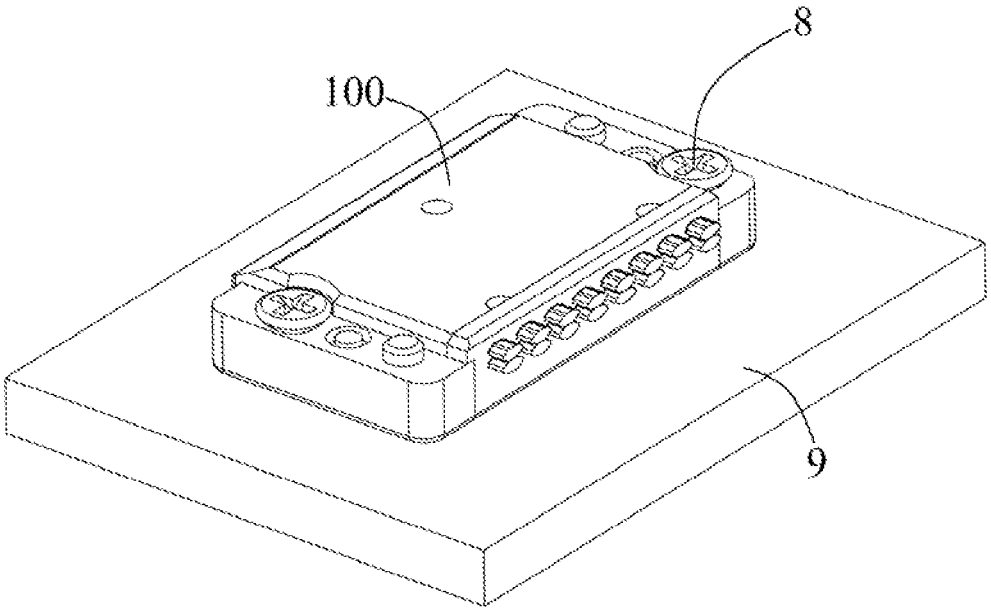
Figure 2:
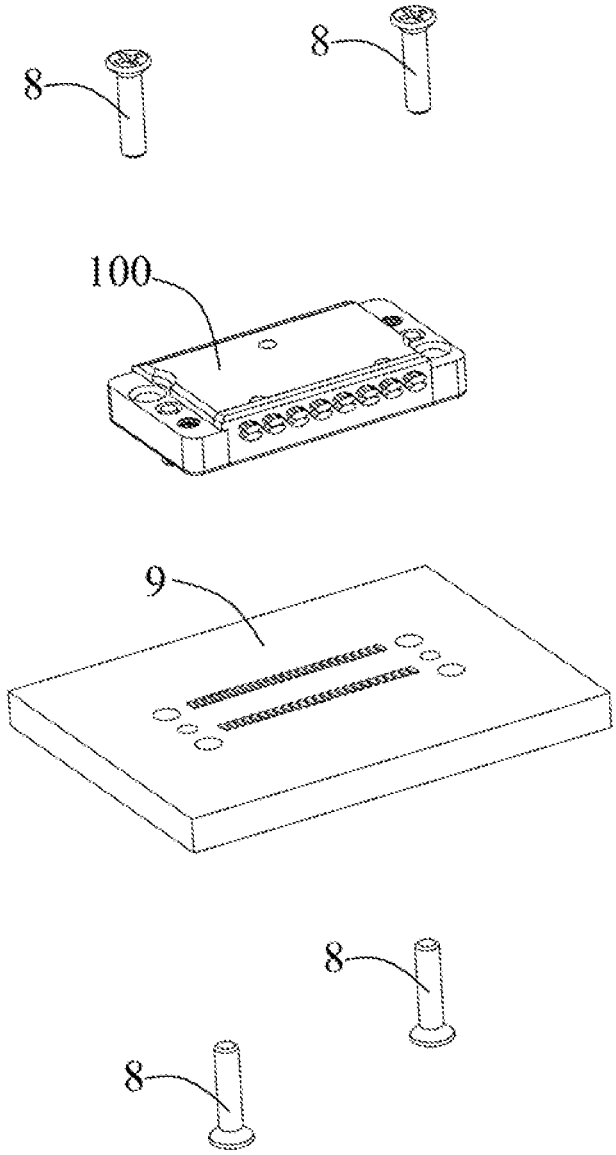
FIG. 2 is a perspective, exploded view of the high-speed connector of the present disclosure and the circuit board where the high-speed connector is mounted.
Figure 3:
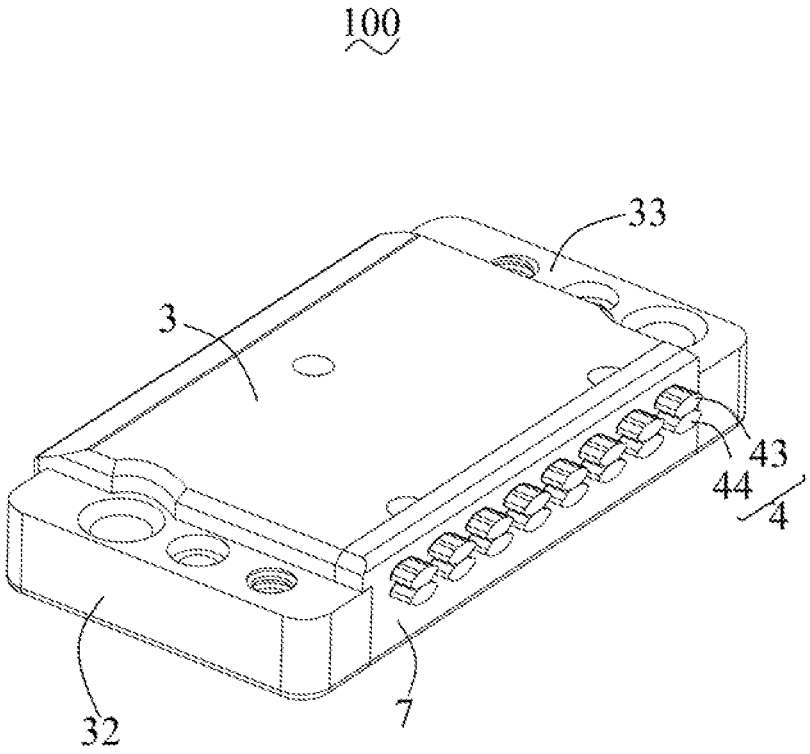
FIG. 3 is a perspective, assembled view of the high-speed connector.
Figure 4:
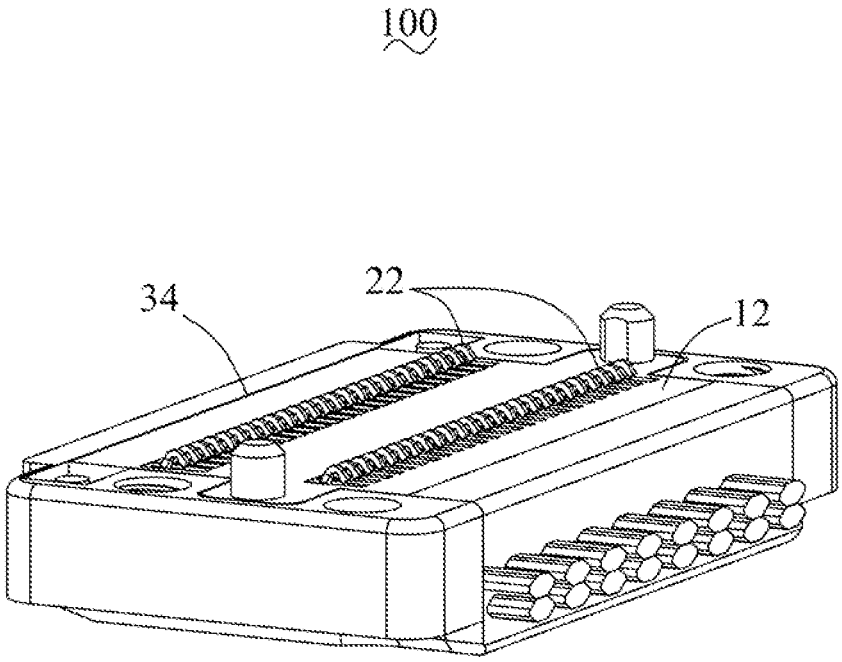
FIG. 4 is similar to FIG. 3 but taken a view from another angle.

Referring to FIGS. 1 to 15, a high-speed connector of the present disclosure includes an insulating body 1, a plurality of conductive terminals 2, a shielding shell 3, a plurality of cables 4, a metal shield 5, an insulating cover 6 and a conductive plastic 7. The insulating body 1 includes an upper surface 11, a lower surface 12, a front surface 13, a back surface 14, a left surface 15 and a right surface 16. The upper surface 11 is opposite to the lower surface 12. The front surface 13 is opposite to the back surface 14. The left surface 15 is opposite to the right surface 16. Each conductive terminal 2 includes a conductive base 21, a first end portion 22 extending from one end of the conductive base 21, and a second end portion 23 extending from the other end of the conductive base 21. The conductive base 21 is retained in the insulating body 1. The first end portion 22 is exposed on the lower surface 12 of the insulating body 1 for connection with a circuit board 9. The second end portion 23 is exposed on the upper surface 11 of the insulating body 1 for connection with the cables 4.

Figure 5:
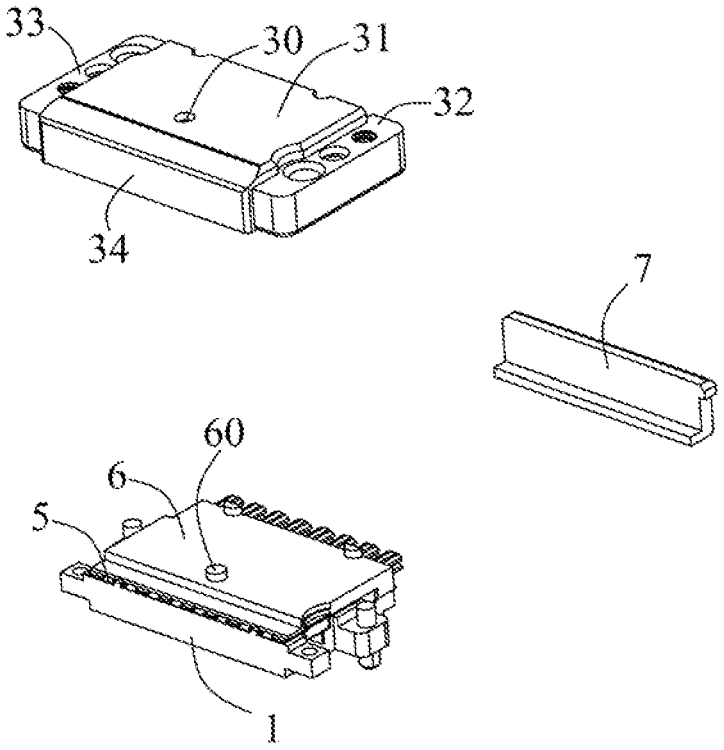
FIG. 5 is a perspective, exploded view of the high-speed connector.
Figure 6:
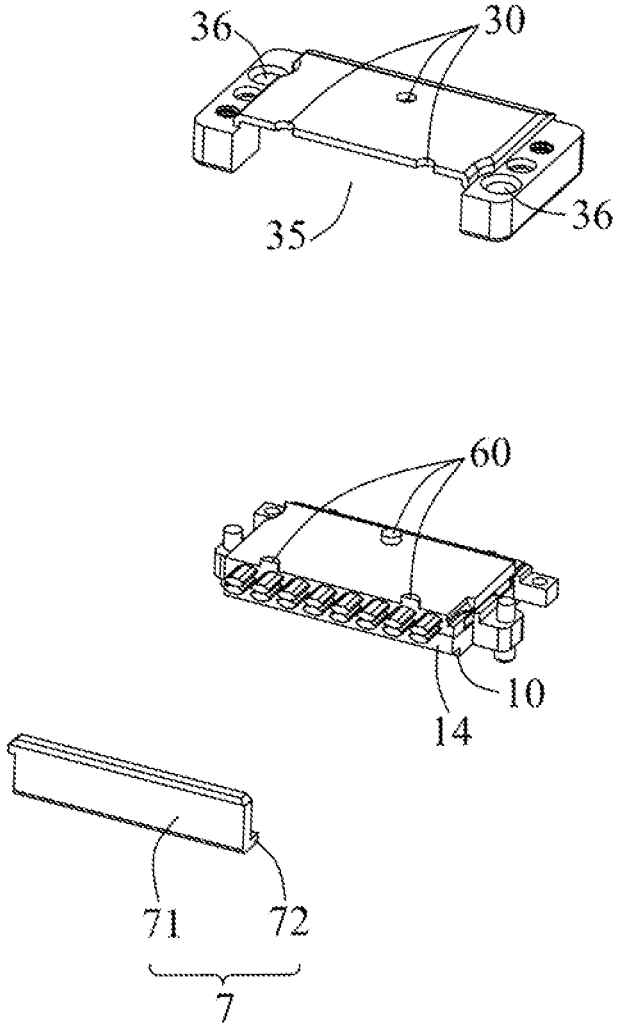
FIG. 6 is similar to FIG. 5 but taken a view from another angle.
Figure 7:
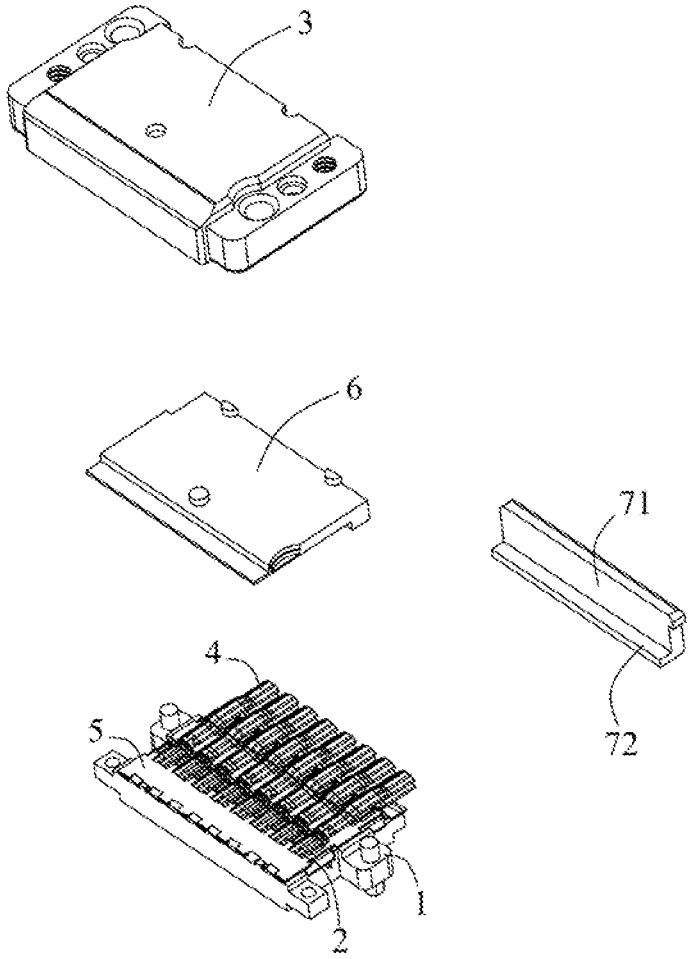
FIG. 7 is a perspective, further exploded view of FIG. 5.

Referring to FIGS. 5 and 6, the shielding shell 3 includes a top baffle wall 31, a left baffle wall 32, a right baffle wall 33 and a front baffle wall 34. The left baffle wall 32, the right baffle wall 33 and the front baffle wall 34 extend downward from the top baffle wall 31. The top baffle wall 31 covers the upper surface 11 of the insulating body 1. The front baffle wall 34 covers the front surface 13 of the insulating body 1. The left baffle wall 32 and the right baffle wall 33 respectively cover the left surface 15 and the right surface 16 of the insulating body 1. The shielding shell 3 does not have a rear baffle at the position of the back surface 14 of the insulating body 1 but is provided with an opening 35 for the cables 4 to pass through. The shielding shell 3 does not have a bottom baffle at the position of the lower surface 12 of the insulating body 1 because the lower surface 12 of the insulating body 1 facing towards the circuit board 9.

Referring to FIGS. 1 to 7, 14 and 15, the conductive plastic 7 is formed on the back surface 14 of the insulating body 1. The cables 4 extend beyond the back surface 14 of the insulating body 1 and pass out of the conductive plastic 7. The insulating body 1 is provided with a recess 10 at the bottom of the back surface 14. The conductive plastic 7 includes a base portion 71 and a convex portion 72 integrally and vertically bends from the base portion 71, and so, the base portion 71 is so-called vertical base portion 71 and a convex portion 72 is so-called horizontal convex portion 72. The convex portion 72 extends forward into the recess 10, so as to enhance the connection between the conductive plastic 7 and the insulating body 1.

Referring to FIGS. 3 to 8, the cables 4 and the conductive plastic 7 are tightly combined. Specifically, the conductive plastic 7 abuts against the top baffle wall 31, the left baffle wall 32 and the right baffle wall 33 of the shielding shell 3. The conductive plastic 7 and the shielding shell 3 are in contact with each other at the top baffle wall 31, the left baffle wall 32 and the right baffle wall 33, so that the conductive plastic 7 and the shielding shell 3 can achieve a grounding effect together.

Figure 9:
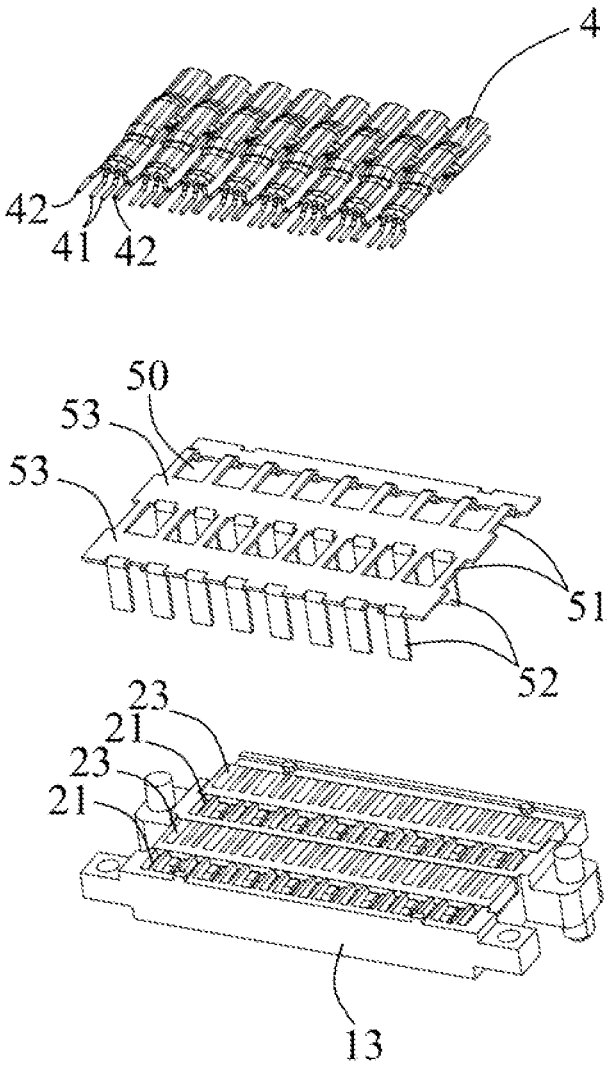
FIG. 9 is a perspective, exploded view of FIG. 7 except for the shielding shell, the insulating cover and the conductive plastic.
Figure 10:
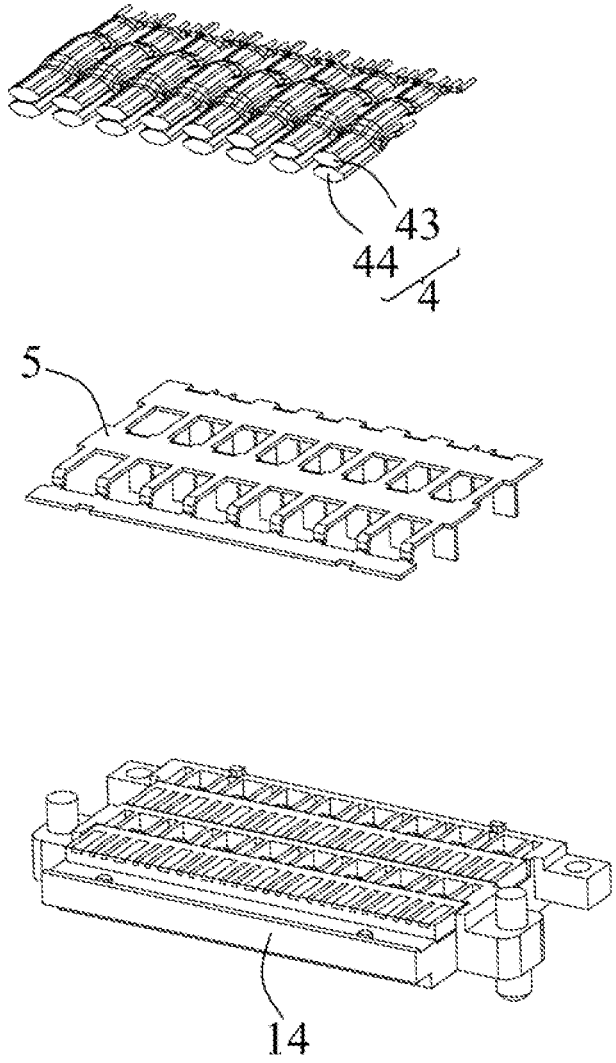
FIG. 10 is similar to FIG. 9 but taken a view from another angle.
Figure 13:
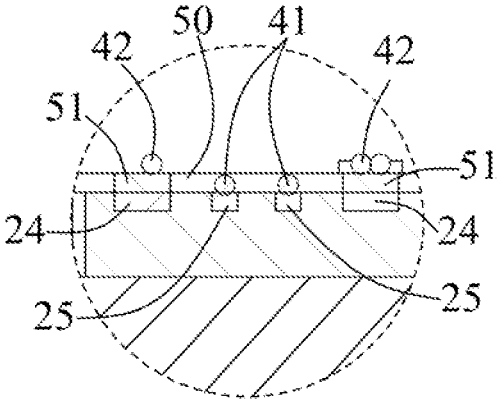
FIG. 13 is a partial enlarged view of FIG. 12.
Figure 14:
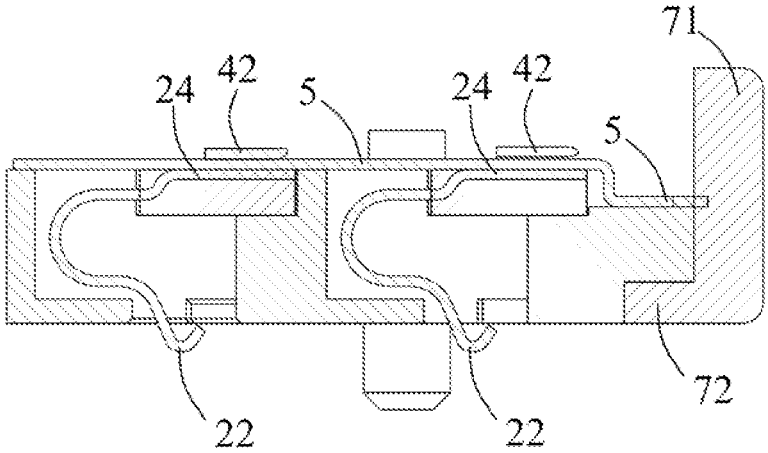
FIG. 14 is a cross-sectional view when taken along line B-B in FIG. 11.
Figure 15:
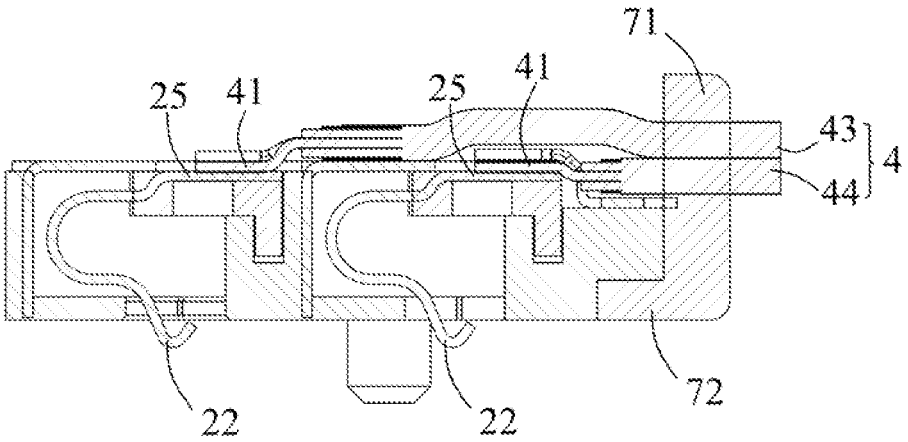
FIG. 15 is a cross-sectional view when taken along line C-C in FIG. 11.

Referring to FIGS. 9 and 13, the conductive terminals 2 include a plurality of grounding terminals 24 and two signal terminals 25 located between two adjacent grounding terminals 24. Each cable 4 includes two signal wire cores 41 connected to the signal terminals 25 and at least one grounding wire core 42 connected to the corresponding grounding terminal 24. The at least one grounding wire core 42 is located beside the two signal wire cores 41 of the cable 4. In a preferred embodiment, each cable 4 includes two grounding wire cores 42. The two grounding wire cores 42 are respectively located on the left and right lateral sides of the two signal wire cores 41 of the cable 4.

Referring to FIGS. 7 to 10 and FIG. 14, the metal shield 5 extends out of the back surface 14 of the insulating body 1. The metal shield 5 is connected to the conductive plastic 7. The metal shield 5 includes a plurality of first longitudinal extension portions 51 extending along the front-back direction and so, the first longitudinal extension portions 51 are so-called front-back extension portions 51. The first longitudinal extension portions 51 abut above the second end portions 23. The grounding wire cores 42 abut above the first longitudinal extension portions 51. The metal shield 5 is provided with a cutout 50 between the adjacent first longitudinal extension portions 51. The signal wire cores 41 extend into the cutout 50 and abut against the signal terminals 25.

Figure 8:
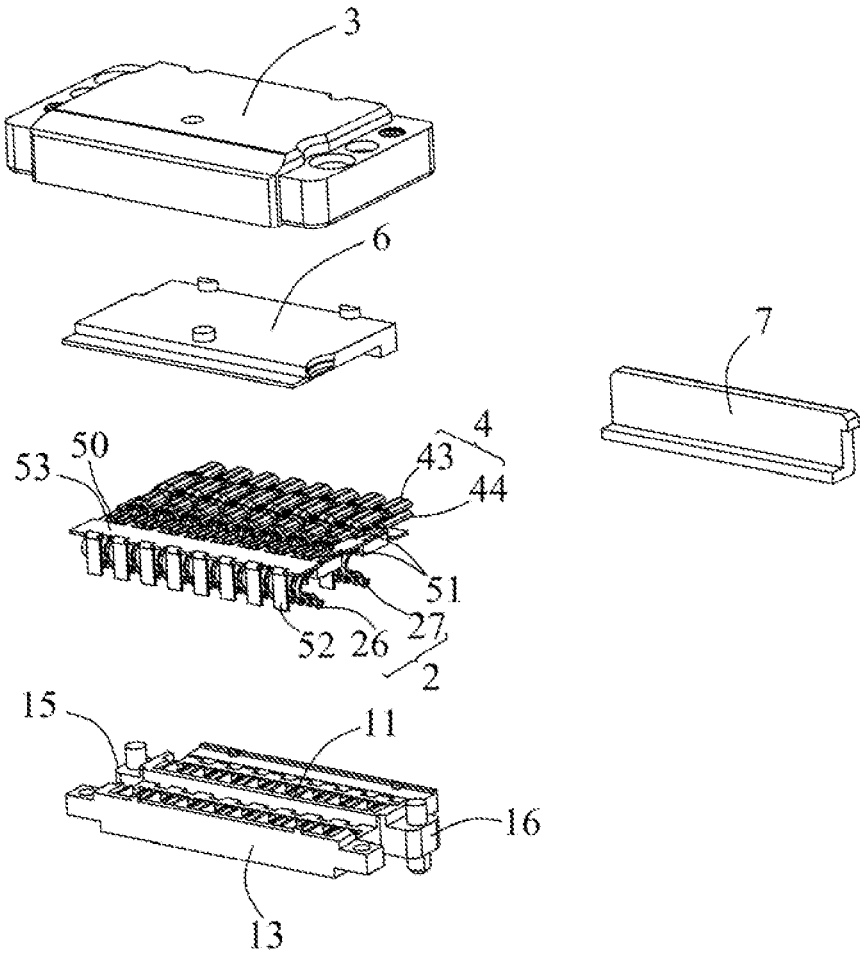
FIG. 8 is a perspective, further exploded view of FIG. 7.
Figure 11:
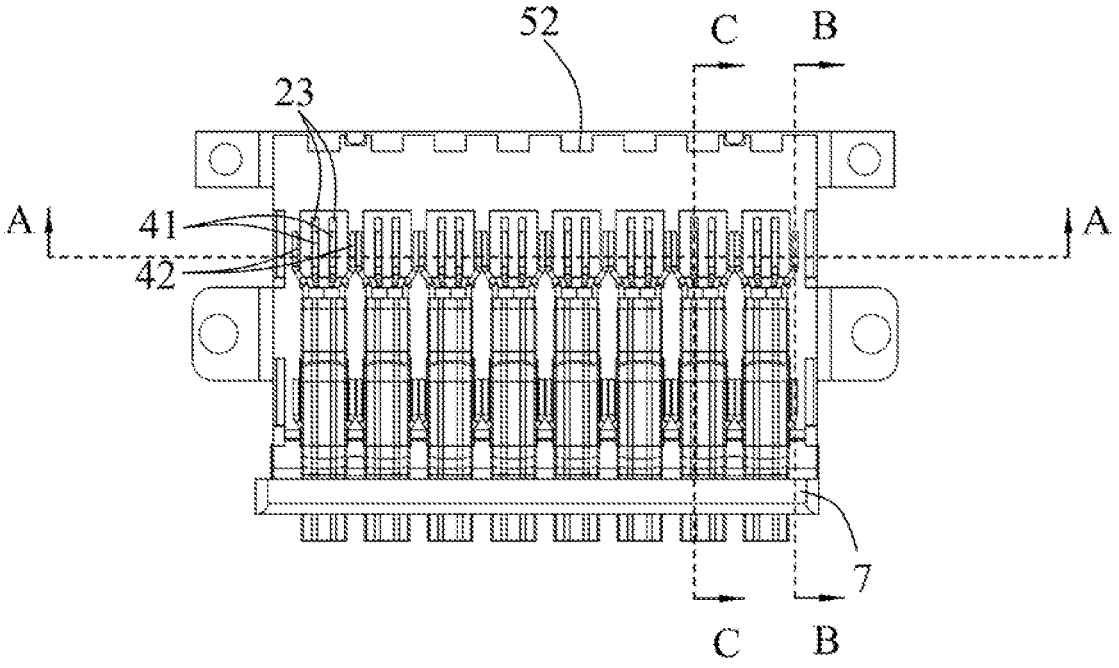
FIG. 11 is a top plane view of the high-speed connector of the present disclosure, when the shielding shell and the insulating cover are removed.
Figure 12:
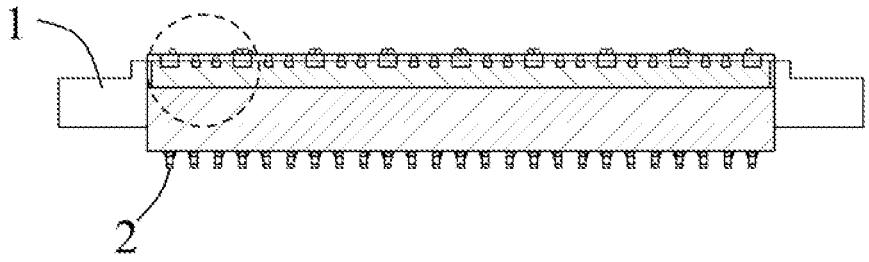
FIG. 12 is a cross-sectional view when taken along line A-A in FIG. 11.

Referring to FIG. 8, FIG. 9 and FIG. 11, the metal shield 5 includes a plurality of second longitudinal extension portions 52 extending along the upper-lower direction and so, the second longitudinal extension portions 52 are so-called upper-lower extension portions 52. Each second longitudinal extension portion 52 is located in front of the corresponding cutout 50 and is used to shield the corresponding signal terminals 25, so that the second longitudinal extension portions 52 have shielding effect on the signal terminals 25.

Referring to FIG. 9, the metal shield 5 further includes a transverse extension portion 53 connected between the first longitudinal extension portions 51 and the second longitudinal extension portions 52. The transverse extension portion 53 extends in the left-right direction. The transverse extension portion 53 and the first longitudinal extension portions 51 are located in the same horizontal plane. The second projecting portions 52 are bent vertically from the transverse extension portion 53 by 90 degrees. The first longitudinal extension portions 51 and the second longitudinal extension portions 52 are located on both sides of the transverse extension portion 53 in the front-back direction. Each first longitudinal extension portion 51 and each second longitudinal extension portion 52 are staggered in the left-right direction.

Referring to FIG. 8, FIG. 11, FIG. 14 and FIG. 15, the conductive terminals 2 include a plurality of first conductive terminals 26 in the front row and a plurality of second conductive terminals 27 in the back row. The cables 4 include a front row of first cables 43 electrically connected to the first conductive terminals 26 and a back row of second cables 44 electrically connected to the second conductive terminals 27. The first cables 43 and the second cables 44 pass out of the conductive plastic 7 in two upper-lower arranged rows. Corresponding to the conductive terminals 2, the first longitudinal extension portions 51 and the second longitudinal extension portions 52 are respectively arranged in the front-back rows. The first cables 43 are connected to the first conductive terminals 26 in the front row. The first cables 43 passes out of the conductive plastic 7 from the upper layer. The second cables 44 are connected to the second conductive terminals 27 in the back row. The second cables 44 pass out of the conductive plastic 7 from the lower layer. Each first end portion 22 is an arc-shaped portion capable of elastically abutting against the circuit board 9. Each second end portion 23 is a flat portion welded to the cable 4.

Referring to FIGS. 1 to 8, the insulating cover 6 fixes the conductive terminals 2, the metal shield 5 and the cables 4 into one body. The insulating cover 6 is located between the upper surface 11 of the insulating body 1 and the top baffle wall 31 of the shielding shell 3. The insulating cover 6 includes a positioning bar 60 and the shielding shell 3 includes a positioning hole 30 receiving the positioning bar 60. The positioning bar 60 is matched with the positioning hole 30 for aligning the shielding shell 3 on the insulating cover 6 and assembling the shielding shell 3 on the insulating body 1. The left baffle wall 32 and the right baffle wall 33 of the shielding shell 3 respectively define some through holes 36, so that bolts 8 pass through the through holes 36 for positioning the shielding shell 3 on the circuit board 9. The insulating cover 6 is formed during the first injection molding. The conductive plastic 7 is formed during the second injection molding after the insulating body 1, the conductive terminals 2, the metal shield 5, the cables 4, the insulating cover 6, and the shielding shell 3 are all installed in place.

Overall, the shielding shell 3 provides protection at the upper surface 11, the left surface 15, the right surface 16, and the front surface 13 of the insulating body 1 except for the back surface 14 of the insulating body 1. That is, the shielding shell 3 realizes basic protection. After the cables 4 are welded to the conductive terminals 2 and penetrate the back surface 14 of the insulating body 1, the conductive plastic 7 is secondarily molded to achieve better and more comprehensive protection. In the present disclosure, the conductive plastic 7 is disposed on the back surface 14 of the insulating body 1 so as to prevent the interference of electromagnetic signals at the back surface 14 of the insulating body 1 where the cables 4 pass through.

The above embodiments are only used to illustrate the present disclosure and not to limit the technical solutions described in the present disclosure. The understanding of this specification should be based on those skilled in the art. Descriptions of directions, such as "front", "back", "left", "right", "upper" and "lower", although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A high-speed connector, comprising: an insulating body having a back surface; a plurality of conductive terminals retained in the insulating body; a conductive plastic disposed on the back surface of the insulating body; and a plurality of cables being electrically connected with the conductive terminals, the cables extending beyond the back surface of the insulating body, and the cables passing out of the conductive plastic; wherein the insulating body defines a recess at a bottom of the back surface, the conductive plastic includes a vertical base portion attaching to the back surface and a horizontal convex portion extending into the recess, and the horizontal convex portion integrally bends from the vertical base portion.

2. The high-speed connector according to claim 1, further comprising an insulating cover, wherein the insulating body comprises a lower surface facing towards a circuit board and an upper surface opposite to the lower surface, and the insulating cover is assembled on the upper surface of the insulating body.

3. The high-speed connector according to claim 2, further comprising a shielding shell covering the insulating cover, wherein the insulating cover comprises a positioning bar, and the shielding shell comprises a positioning hole in which the positioning bar is received.

4. The high-speed connector according to claim 3, wherein the shielding shell comprises a top baffle wall, a left baffle wall, a right baffle wall and a front baffle wall, the top baffle wall, the left baffle wall, the right baffle wall and the front baffle wall provide protection to four different surfaces of the insulating body.

5. The high-speed connector according to claim 4, wherein the conductive plastic abuts against the top baffle wall, the left baffle wall and the right baffle wall of the shielding shell.

6. The high-speed connector according to claim 1, further comprising a metal shield extending out of the back surface of the insulating body and being connected to the conductive plastic.

7. The high-speed connector according to claim 6, wherein the conductive terminals comprise a plurality of grounding terminals and a plurality of signal terminals, the cables comprise a plurality of signal wire cores connecting with the grounding terminals and a plurality of grounding wire cores connecting with the signal terminals, the metal shield comprises a plurality of first longitudinal extension portions extending along a front-back direction, the grounding wire cores abut above the first longitudinal extension portions, and the first longitudinal extension portions abut above the grounding terminals.

8. The high-speed connector according to claim 7, wherein the metal shield comprises a plurality of second longitudinal extension portions extending along an upper-lower direction, and the second longitudinal extension portions shield the corresponding signal terminals.

9. The high-speed connector according to claim 8, wherein the metal shield defines a cutout between each two adjacent first longitudinal extension portions, the second longitudinal extension portions extend forwardly and downwardly beyond the cutouts, and the signal wire cores abut against the signal terminals in the cutouts.

10. A high-speed connector, comprising: an insulating body having a lower surface and a back surface that is distinguished from the lower surface;

a shielding shell covering the insulating body except for the lower surface and the back surface; a plurality of conductive terminals retained in the insulating body, the conductive terminals extending below the lower surface of the insulating body for connection with a circuit board; and a conductive plastic disposed on the back surface of the insulating body; wherein the insulating body defines a recess at a bottom of the back surface, the conductive plastic includes a base portion attaching to the back surface and a convex portion extending into the recess, and the convex portion integrally and vertically bends from the base portion.

11. The high-speed connector according to claim 10, further comprising an insulating cover sandwiched between the insulating body and the shielding shell along an upper-lower direction.

12. The high-speed connector according to claim 11, wherein the insulating body comprises an upper surface opposite to the lower surface, the shielding shell comprises a top baffle wall located above the upper surface, and the insulating cover is sandwiched between the upper surface of the insulating body and the top baffle wall of the shielding shell.

13. The high-speed connector according to claim 12, wherein the shielding shell further comprises a left baffle wall, a right baffle wall and a front baffle wall, the insulating body further comprises a front surface opposite to back surface, a left surface and a right surface opposite to the left surface, the left baffle wall and the right baffle wall are respectively positioned to shield the left surface and the right surface, and the front baffle wall is positioned to shield the front surface.

14. The high-speed connector according to claim 13, wherein the conductive plastic abuts against the top baffle wall, the left baffle wall and the right baffle wall of the shielding shell.

15. The high-speed connector according to claim 10, further comprising a metal shield extending beyond the back surface of the insulating body and being connected to the conductive plastic.

16. The high-speed connector according to claim 15, wherein the conductive terminals comprise a plurality of grounding terminals and a plurality of signal terminals, the cables comprise a plurality of signal wire cores connecting with the grounding terminals and a plurality of grounding wire cores connecting with the signal terminals, the metal shield comprises a plurality of front-back extension portions, the grounding wire cores abut above the front-back extension portions, and the front-back extension portions abut above the grounding terminals.

17. The high-speed connector according to claim 16, wherein the metal shield comprises a plurality of upper-lower extension portions shielding the corresponding signal terminals.

18. The high-speed connector according to claim 17, wherein the metal shield defines a cutout between each two adjacent front-back extension portions, each upper-lower extension portion extends forwardly and downwardly beyond the corresponding cutout, and the signal wire core abuts against the corresponding signal terminal in the corresponding cutout.

* * * * *